US009970712B2

(12) United States Patent
Bastian et al.

(10) Patent No.: US 9,970,712 B2
(45) Date of Patent: May 15, 2018

(54) ROTARY HIGH DENSITY HEAT EXCHANGER

(71) Applicants: John Carl Bastian, Yorkville, IL (US); John David Jude, Scottsdale, AZ (US)

(72) Inventors: John Carl Bastian, Yorkville, IL (US); John David Jude, Scottsdale, AZ (US)

( * ) Notice: Subject to any disclaimer, the term of this patent is extended or adjusted under 35 U.S.C. 154(b) by 320 days.

(21) Appl. No.: 14/962,643

(22) Filed: Dec. 8, 2015

(65) Prior Publication Data

US 2016/0091255 A1 Mar. 31, 2016

Related U.S. Application Data

(63) Continuation of application No. 13/762,086, filed on Feb. 7, 2013, now Pat. No. 9,243,850.

(51) Int. Cl.

| | |
|---|---|
| ***F28D 11/02*** | (2006.01) |
| ***F28F 3/02*** | (2006.01) |
| ***F28F 3/12*** | (2006.01) |
| ***F28F 9/02*** | (2006.01) |
| ***F28F 13/12*** | (2006.01) |
| ***F28F 17/00*** | (2006.01) |
| ***F28D 11/04*** | (2006.01) |

(52) U.S. Cl.

CPC ..... *F28D 11/02* (2013.01); *F28D 11/04* (2013.01); *F28F 3/02* (2013.01); *F28F 3/12* (2013.01); *F28F 9/02* (2013.01); *F28F 13/125* (2013.01); *F28F 17/005* (2013.01)

(58) Field of Classification Search

CPC ..... F28F 3/02; F28F 3/12; F28F 5/00; F28F 5/02; F28F 5/04; F28F 5/06; F28F 13/12; F28F 13/185; F28F 13/125; F28D 11/00; F28D 11/02; F28D 11/04; F28D 11/08

USPC ..... 165/86, 87, 88, 109.1; 366/147

See application file for complete search history.

(56) References Cited

U.S. PATENT DOCUMENTS

| | | | | |
|---|---|---|---|---|
| 1,260,194 | A * | 3/1918 | Higgins | B29C 47/84 165/87 |
| 1,587,840 | A | 6/1926 | Kilmer | |
| 1,667,944 | A | 5/1928 | Nichols | |
| 3,020,025 | A * | 2/1962 | O'Mara | F28D 11/02 159/25.1 |
| 3,168,431 | A | 2/1965 | Spielvogel | |
| 3,216,486 | A * | 11/1965 | Hall | F28D 19/048 165/10 |
| 3,266,564 | A | 8/1966 | Sabatiuk | |
| 3,295,597 | A * | 1/1967 | Ingeborg | F28D 19/04 165/86 |
| 3,430,690 | A * | 3/1969 | Sciaux | B01D 1/222 159/6.1 |
| 3,612,168 | A | 10/1971 | Peterson | |
| 3,926,010 | A | 12/1975 | Eskeli | |
| 4,073,338 | A | 2/1978 | Fujikake et al. | |
| 4,449,379 | A | 5/1984 | Dibrell | |
| 4,582,128 | A * | 4/1986 | Jarreby | D21F 5/021 122/26 |
| 4,640,345 | A | 2/1987 | Nishimura | |

(Continued)

*Primary Examiner* — Keith Raymond
*Assistant Examiner* — Gustavo Hincapie Serna
(74) *Attorney, Agent, or Firm* — McDonald Hopkins LLC

(57) ABSTRACT

The present invention relates generally to the rotary high density heat exchangers. In one embodiment, the present invention relates to rotary high density heat exchangers that contain one or more fan blades where each fan blade contains heat exchanging surfaces on the surface thereof.

40 Claims, 10 Drawing Sheets

(56) References Cited

U.S. PATENT DOCUMENTS

| | | | | |
|---|---|---|---|---|
| 4,770,236 | A | 9/1988 | Kulikowski | |
| 6,419,009 | B1 * | 7/2002 | Gregory | F28D 1/053 165/144 |
| 6,959,756 | B2 * | 11/2005 | Woodard | F16C 37/00 165/185 |
| 7,540,651 | B2 | 6/2009 | Matsumoto et al. | |

* cited by examiner

ROTARY HIGH DENSITY HEAT EXCHANGER

RELATED APPLICATION DATA

This patent application claims priority to and is a continuation of U.S. patent application Ser. No. 13/762,086, filed Feb. 7, 2013 (now U.S. Pat. No. 9,243,850) and titled "Rotary High Density Heat Exchanger." The complete text of this patent application is hereby incorporated by reference as though fully set forth herein in its entirety.

FIELD OF THE INVENTION

The present invention relates generally to the rotary high density heat exchangers. In one embodiment, the present invention relates to rotary high density heat exchangers that contain one or more fan blades where each fan blade contains heat exchanging surfaces on the surface thereof.

BACKGROUND OF THE INVENTION

It has been a long time goal of the thermal management community to have a method to remove high thermal energy loads without the use of large surface area heat exchangers. Conventional designs of cooling products such as vapor compression based refrigeration systems; all use the same basic components to accomplish cooling or heating. Over the long history of refrigerant based vapor compression systems, only incremental advancements in the technology have been made resulting in relatively small increases in system efficiency and effectiveness. While compressors are more efficient, evaporator and condenser heat exchangers are only incrementally better and as such the basic technology has progressed rather slowly over the last 70 years.

If one looks at these basic components, some inherent inefficiencies become apparent quickly. Consider a typical condensing coil unit. It is generally a large array of finned tube coils through which a fan either pulls air across or pushes air over. The finned coils are fairly efficient at exchanging thermal energy with airflow, but considerable work must be performed to provide adequate airflow across the coils for significant heat exchange. No matter how efficient the exchanger may be, thermal energy must be removed from the system. In an air cooled system the volumetric airflow required for proper heat transfer is significant.

In general terms, the capacity of a heat exchanger is directly proportional to its surface area. It is also proportional to the temperature and volume of air flowing across its exposed surface area. These and other factors must be considered when designing an efficient exchanger.

When considering the state of the art in heat exchanger technology, in large part, inefficiency revolves around the movement of air and air mover technology utilized for thermal exchangers. Whether a blower, tube axial fan, bladed fan or some other structure is utilized, the process of air movement is extremely inefficient ranging from a low of 6 percent to a high of 60 percent, depending on method and size. If one includes one or more electric motors into the efficiency calculation, the overall efficiency drops to 50 percent at best. To compensate for these inefficiencies, exchanger systems are designed to be larger and heavier.

One solution to these issues is proposed by U.S. Pat. No. 3,020,025 which is directed to a heat exchanger that is adapted to be rotated during operation and particularly to a device in the form of a double hollow shaft assembly having a number of fins or paddles spaced there along including fins which may be selectively adjusted as to angular inclination and fins which employ a substantial portion of their volume for circulation of heat exchange fluid therein.

As can be seen from the disclosure contained in U.S. Pat. No. 3,020,025, the heat exchanger disclosed therein utilizes fin assemblies that have one or more pipes located along the center line of a fin assembly, where such one or more pipes are able to contain a heat transfer fluid. While the heat exchanger of U.S. Pat. No. 3,020,025 seeks to increase the operating efficiency thereof, this heat exchanger device suffers from a number of drawbacks. For example, if one were to use the design of U.S. Pat. No. 3,020,025 to create a heat exchanger where a high rate of rotation was required by the fin assemblies disclosed therein, such high rate of rotation would cause pooling of the heat transfer fluid at the end of the fin assemblies due in part to the centrifugal forces created by a high rate of rotation.

Accordingly, given the above, a need exists in the art for a rotary heat exchanger with improved system efficiency.

SUMMARY OF THE INVENTION

The present invention relates generally to the rotary high density heat exchangers. In one embodiment, the present invention relates to rotary high density heat exchangers that contain one or more fan blades where each fan blade contains heat exchanging surfaces on the surface thereof.

Accordingly, one aspect of the present invention is drawn to a rotary high density heat exchanger comprising: a center shaft, wherein the center shaft is designed to permit the transfer of a heat transfer media; at least two heat exchanger blades, wherein each of the at least two further comprises at least one heat transfer passageway within the internal structure of the blade that are fluidically connected to the center shaft so as to permit the flow of heat transfer media from the center shaft to an outer edge of a respective heat exchanger blade; a heat transfer media collector, wherein the heat transfer media collector is fluidically connected to at least one outer portion of a respective heat transfer passageway in order to collect cooled heat transfer media; and a double hollow shaft, wherein one portion of the double hollow shaft is designed to be fluidically connected the center shaft in order to supply hot, or heated, heat transfer media to the center shaft and wherein the other portion of the double hollow shaft is designed to be fluidically connected the heat transfer media collector in order to supply cooled heat transfer media for a cooling application, wherein the passageway in each of the at least two heat exchanger blades is serpentine in shape.

In yet another aspect of the present invention, there is provided a rotary high density heat exchanger comprising: a center shaft, wherein the center shaft is designed to permit the transfer of a heat transfer media; at least two heat exchanger blades, wherein each of the at least two further comprises at least one heat transfer passageway within the internal structure of the blade that are fluidically connected to the center shaft so as to permit the flow of heat transfer media from the center shaft to an outer edge of a respective heat exchanger blade; a heat transfer media collector, wherein the heat transfer media collector is fluidically connected to at least one outer portion of a respective heat transfer passageway in order to collect cooled heat transfer media; a pump that is fluidically connected to the respective heat transfer media collector and to a double hollow shaft, wherein one portion of the double hollow shaft is designed to be fluidically connected the center shaft in order to supply hot, or heated, heat transfer media to the center shaft and wherein the other portion of the double hollow shaft is designed to be fluidically connected the fluid pump and heat transfer media collector in order to supply cooled heat transfer for a cooling application, wherein the passageway in each of the at least two heat exchanger blades is serpentine in shape, and wherein each heat exchanger blade contains a plurality of heat exchange fins one at least one external surface thereof.

The various features of novelty which characterize the invention are pointed out with particularity in the claims annexed to and forming a part of this disclosure. For a better understanding of the invention, its operating advantages and specific benefits attained by its uses, reference is made to the accompanying drawings and descriptive matter in which exemplary embodiments of the invention are illustrated.

DETAILED DESCRIPTION OF THE INVENTION

The present invention relates generally to the rotary high density heat exchangers. In one embodiment, the present invention relates to rotary high density heat exchangers that contain one or more fan blades where each fan blade contains heat exchanging surfaces on the surface thereof.

Given the above, the present invention relates to a rotary heat exchanger that offers both an improvement in efficiencies as well as, in some instances, a reduction is size relative to other rotary heat exchangers of the same heat rating and/or heat transfer capacity/ability. For example, in one instance the present invention permits the design of a rotary heat exchanger that maximizes heat exchange capacities in a package and/or footprint approximately 20 percent of the size of current rotary heat exchangers of similar/same heat rating and/or heat transfer capacity/ability while permitting and/or recognizing a doubling of in the efficiency thereof. In one embodiment, the device of the present invention combines the one or more fan blades of the fan that accomplishes the air flow across the heat exchanging surfaces with the heat exchanging surfaces themselves.

As is illustrated in FIGS. 1 through 3 and 7 through 12, the present invention is directed to a rotary heat exchanger having two or more heat transfer fins, where each fin is designed to receive, transfer and output at least one heat transfer media so that heat is transferred from one area of the rotary heat exchanger to another area of the rotary heat exchanger and/or permitted to bleed to an environment surrounding the rotary heat exchanger.

Figure 1:
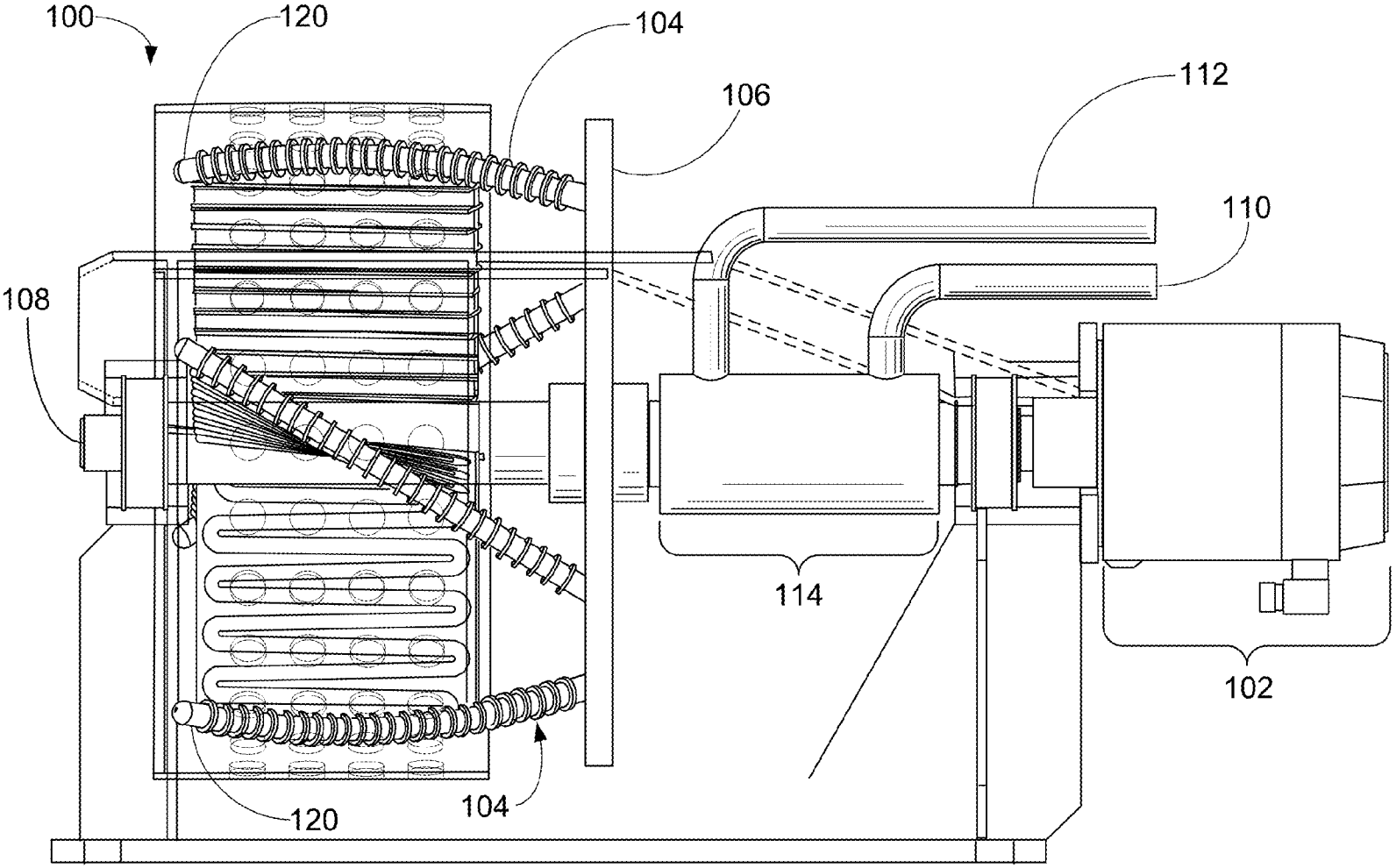
FIG. 1 is a side view of a rotary heat exchanger according to one embodiment of the present invention.

Turning to FIG. 1, FIG. 1 is a side view of a rotary heat exchanger 100 according to one embodiment of the present invention. Rotary heat exchanger 100 comprises at least the following basic elements: an electric motor 102, a set of heat exchanger blades and/or fins 104 (see FIG. 2 for a more detailed view of the heat exchanger blades and/or fins 104) a cooled heat holding media collector 106 that also serves to transfer a cooled, or cooler, heat holding media to a device externally connected to rotary heat exchanger 100 and a center shaft 108. Rotary heat exchanger 100 further comprises heat holding median inlet 110, heat holding media outlet 112 and a heat holding media transfer structure 114 that receives, supplies to the two or more blades 104, and outputs the heat transfer media. Rotary heat exchanger 100 also comprises a shroud 160 that is designed to isolate and/or contain the two or more blades 104 so that blades 104 are shielded, protected and/or isolated. Additional conventional support structures, attachment and/or mounting structures as well as motor support and mounting structure are part of rotary heat exchanger 100 but a detailed discussion thereof is omitted for the sake of brevity as such structures are similar to and/or identical to those of conventional rotary heat exchangers. In one embodiment, a suitable protective structure 160 can be placed around the rotating blades, or fins, 104 in order to provide protection from and to the rotating blades, or fins, 104. In one embodiment, if so present structure 160 so have air flow opening therein. As would be apparent to those of skill in the art, the number, placement and shape of such openings in structure 160 are not limited to the circular openings illustrated in the various Figures of the present invention.

Electric motor 102 can be of any suitable size, voltage amperage, etc. depending upon the intended end use for rotary heat exchanger 100 of the present invention. As would be apparent to those of skill in the art, the present invention is not limited to any one specific set of design criteria. Rather, heat exchanger 100 of the present invention can be designed to be utilized in a wide range of heat exchanger applications and as such no one set of design specification would permit heat exchanger 100 to meet all possible applications for the present invention.

Regarding the various structures of rotary heat exchanger 100, blades and/or fins 104, cooled heat holding media collector 106, center shaft 108, heat holding median inlet 110, heat holding media outlet 112, heat holding media transfer structure 114, and shroud 160 can independently be formed from any suitable material such a metal or metal alloy or other material. Suitable metals include, but are not limited to, aluminum, iron, copper, silver, gold, platinum, nickel, titanium, carbon, carbon composite etc. Suitable metal alloy materials include, but are not limited to, brass, bronze, stainless steel, steel, etc.

Figure 2:
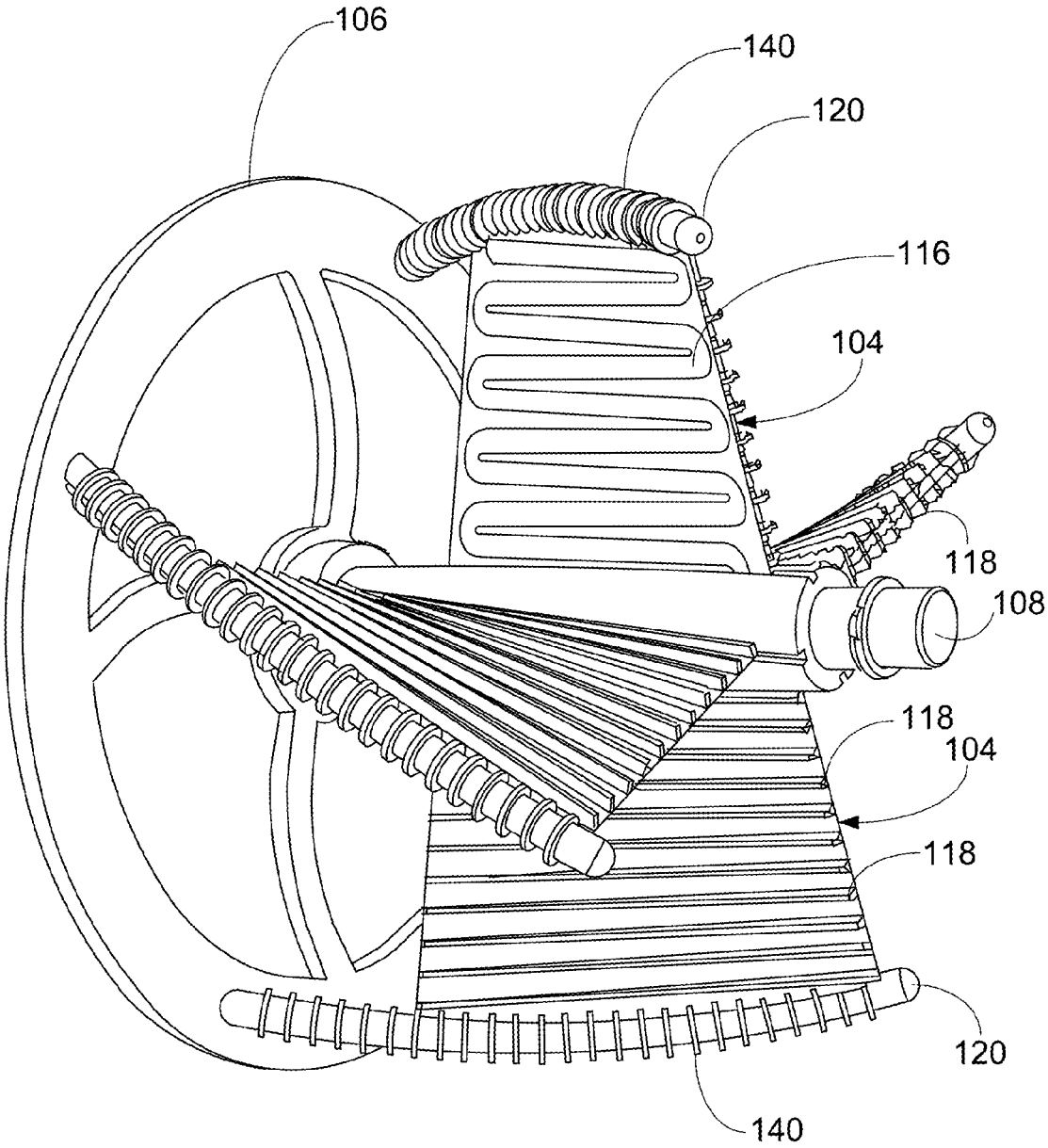
FIG. 2 is a close-up perspective view of the plurality of blades, each respective blade heat transfer structure, and the outlet assembly of the rotary heat exchanger of FIG. 1.
Figure 3:
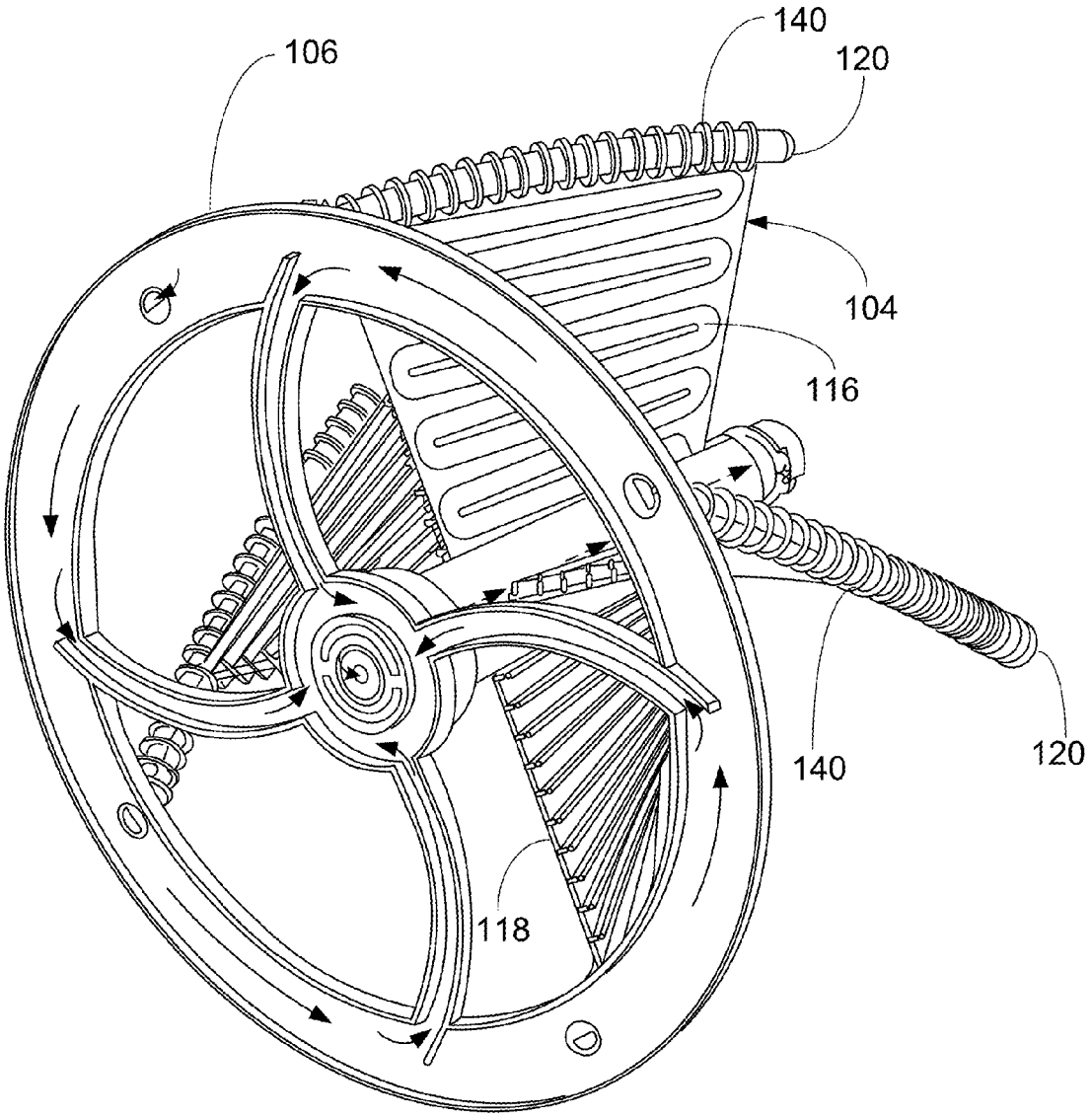
FIG. 3 is a second close-up perspective view of the plurality of blades, each respective blade heat transfer structure, and the outlet assembly of the rotary heat exchanger of FIG. 1.

Turning to FIGS. 2 and 3, these Figures are illustrations of close-ups of the two or more blades and/or fins 104 of the present invention. In one embodiment, each of blades 104 contain an internal heat media passage 116 that radiates outward from the center shaft 108 of rotary heat exchanger 100 and permits the flow there through of a suitable heat holding media (e.g., a refrigerant gas, a heat transfer fluid, etc.). In another embodiment, each of the two or more blades further include a plurality of heat sink fins 118 formed on at least one outer surface of blades 104. In one embodiment, internal heat media passages 116 are connected at one end to cooled heat holding media collector 106 which then transfers the cooled heat holding media to the center of structure 106 and then to heat holding media transfer structure 114. As can be seen in more detail in FIGS. 8, 9, 11 and 24, heat holding media transfer structure 114 is formed from two circular structures a cooled heat holding media transfer ring 122 and a heated, or hot, heat holding media transfer ring 124. Rings 122 and 124 are fluidically connected to heat holding media outlet pipe 112 and heat holding media inlet pipe 110. Inlet pipe 110 supplies heated, or hot, heat holding media to rotary high density heat exchanger 100 for cooling and then the cooled heat holding media is eventually transferred via outlet pipe 112 to a device or situation where cooling is desired (e.g., an air conditioning unit, etc.). In one embodiment of the present invention a pump may be fluidically connected to outlet pipe 112 to assist in the transfer of cooled heat holding media to a device or situation where cooling is desired (e.g., an air conditioning unit, etc.).

Figure 9:
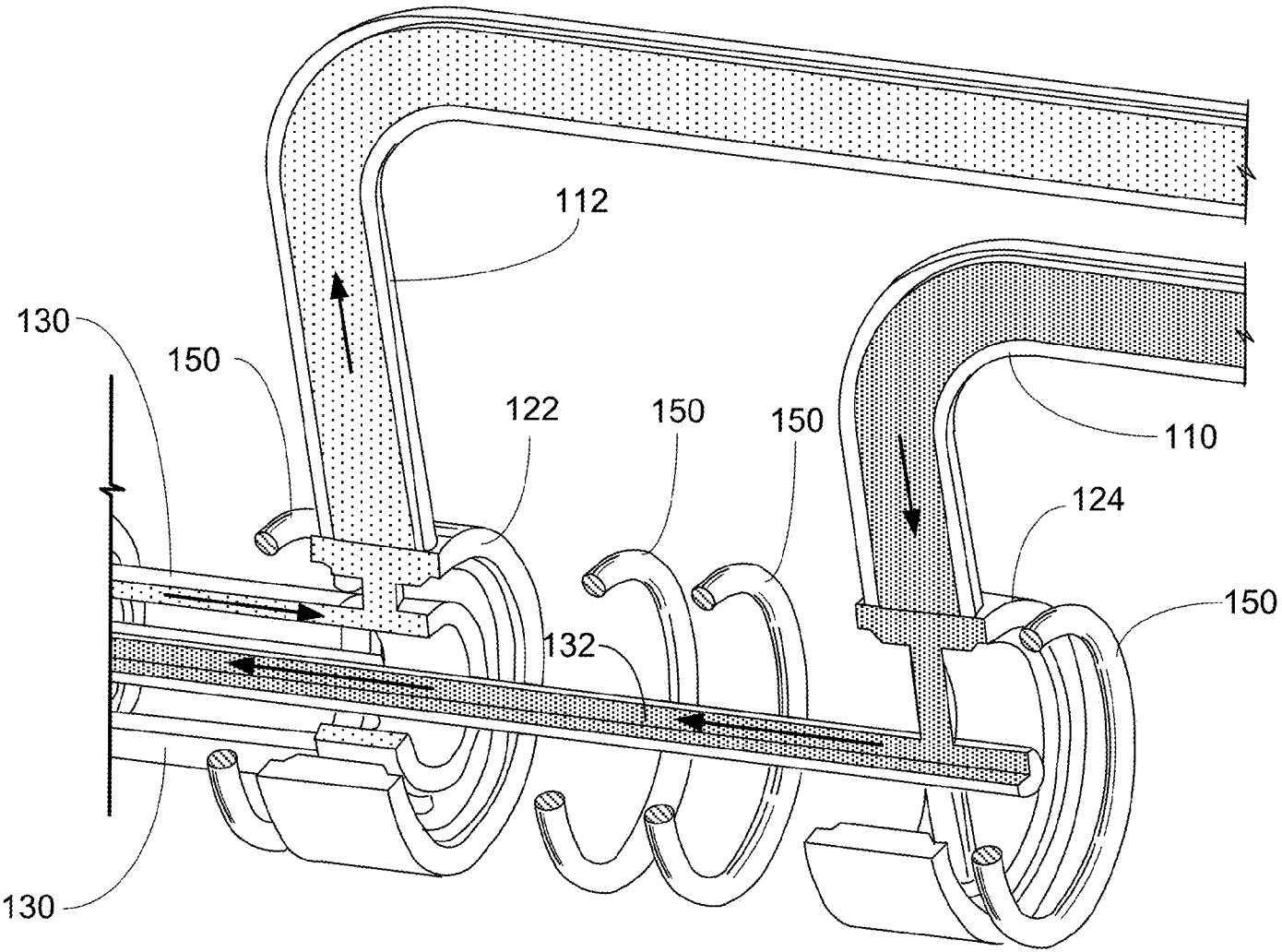
FIG. 9 is a partial exploded close-up cross-sectional view of the inlet and outlet structures for a rotary heat exchanger that facilitate the input of a hot heat holding media and the output of a cooler heat holding media in accordance with one embodiment of the present invention of the rotary heat exchanger of FIG. 1.
Figure 10:
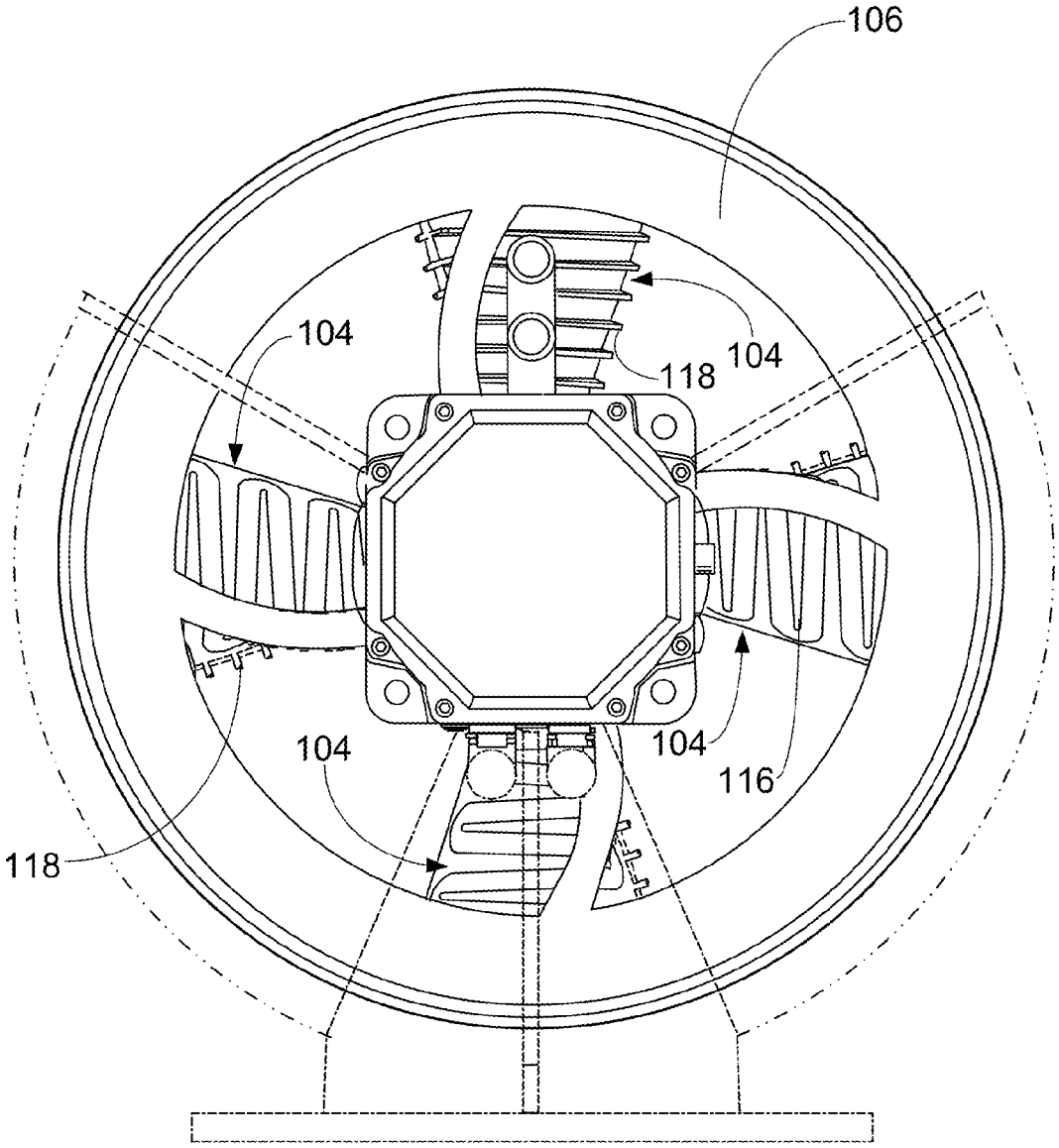
FIG. 10 is an end view of the bladed end of the rotary heat exchanger of FIG. 1.
Figure 11:
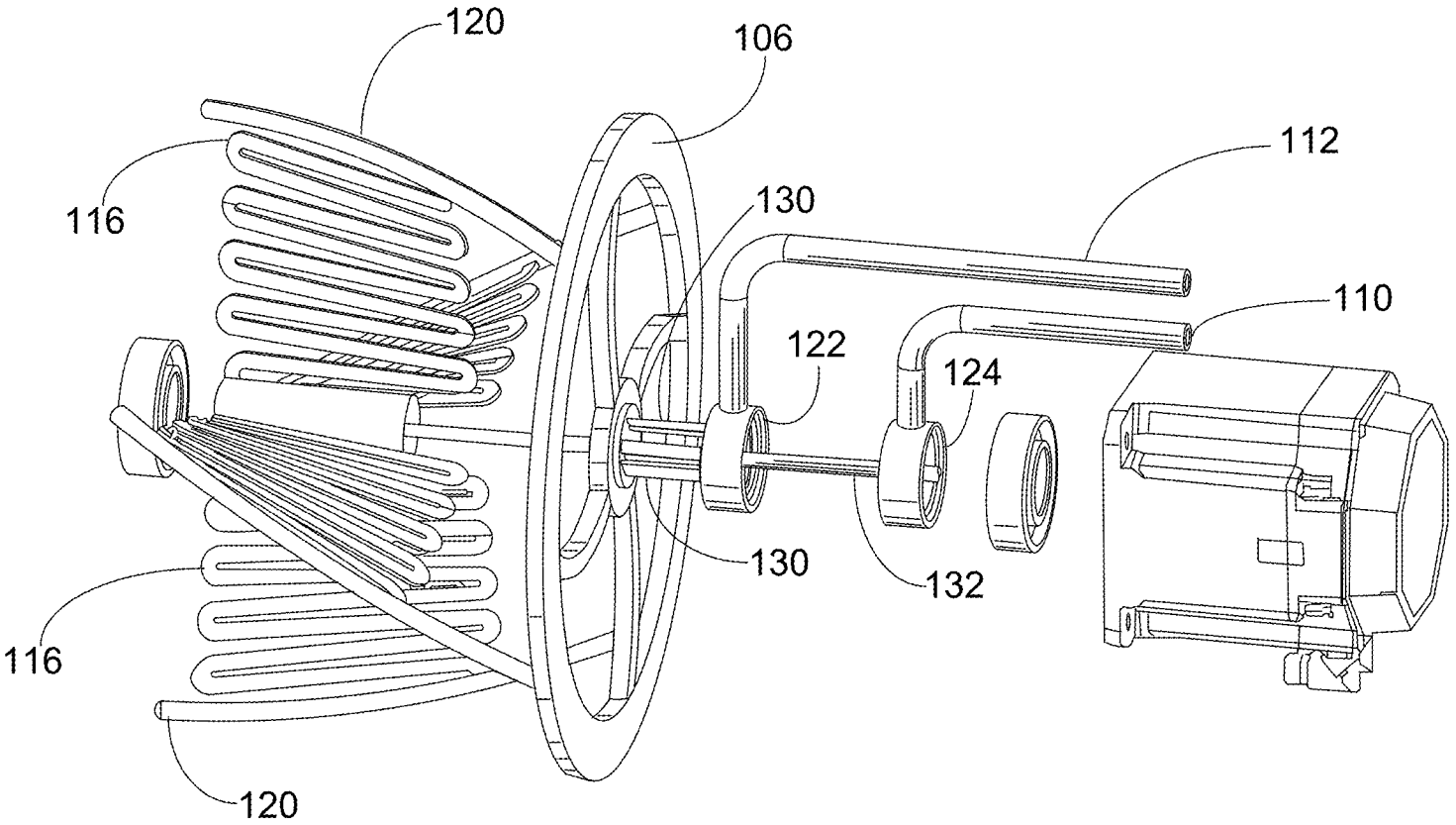
FIG. 11 is a partial exploded side view of the rotary heat exchanger of FIG. 1.
Figure 12:
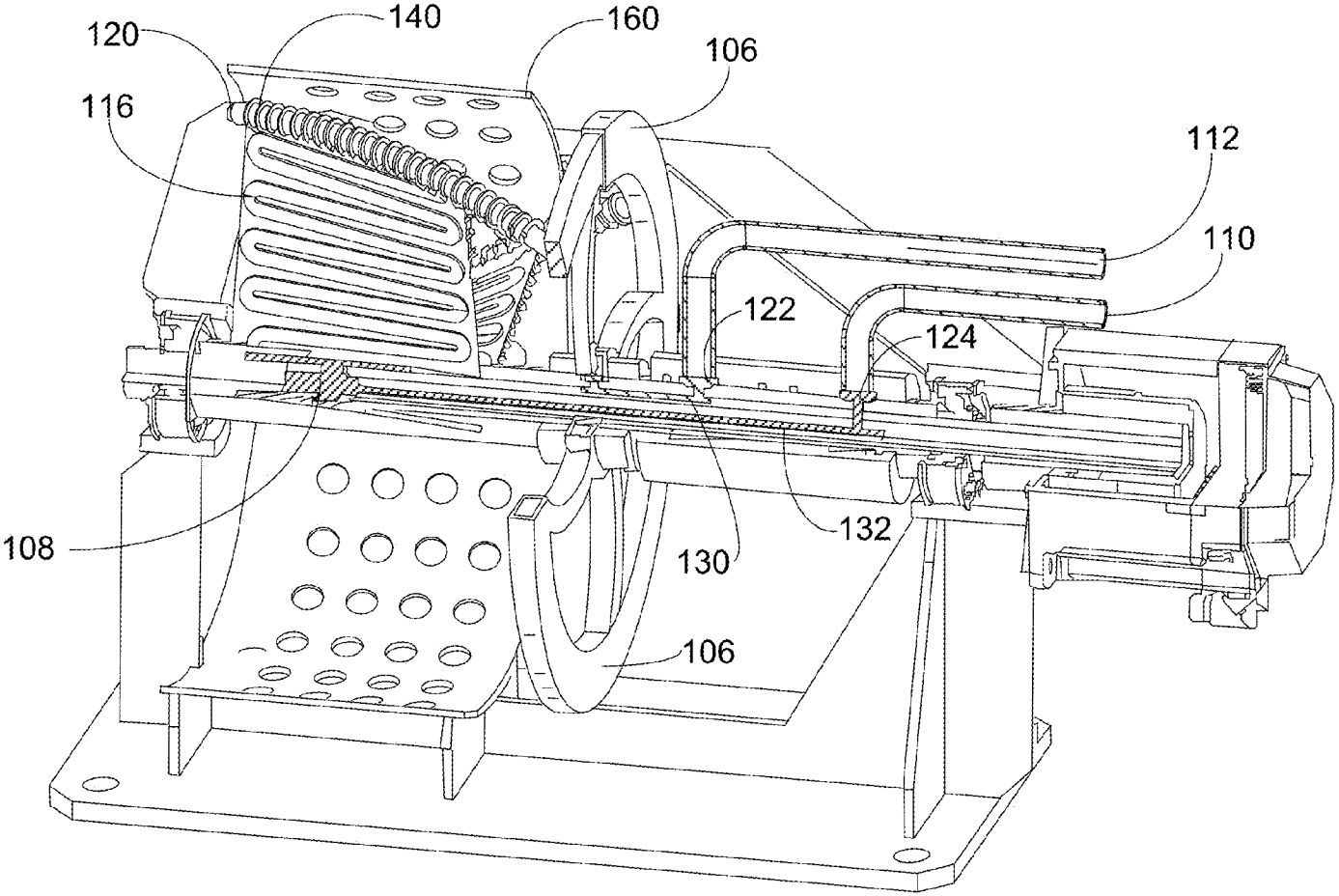
FIG. 12 is a partial cut-away side view of the rotary heat exchanger of FIG. 1.

Regarding the other structures that enable the transfer of the heating holding media from a heated state to a cooled state via high density heat exchanger 100 are illustrated in FIGS. 9, 11 and 12. Turning to these Figures, cooled heat holding media transfer ring 122 is fluidically connected to cooled heat holding media collector 106 via at least two fluid channels 130, while "hot" heat holding media transfer ring 124 is fluidically connected to center shaft 108 via fluid channel 132. Fluid channel 132 supplies hot, or heated, heat transfer media to center shaft 108 which then is fluidically connected to the two or more internal heat media passages 116 located in the at least two fins 104. In one embodiment, the outlet end of each individual internal heat media passage 116 is fluidically connected to fluid channel 120 that supplies cooled heat holding to cooled heat holding media collector 106. In one embodiment, fluid channel 120 further comprises heat fins 140 on the outer surface thereof to provide additional cooling. As can be seen from FIGS. 3, 9 and 11, cooled heat holding media is funneled to the center of structure 106 and then fluidically conveyed via the two or more fluid channels 130 to ring 122 and then to outlet pipe 112.

Figure 8:
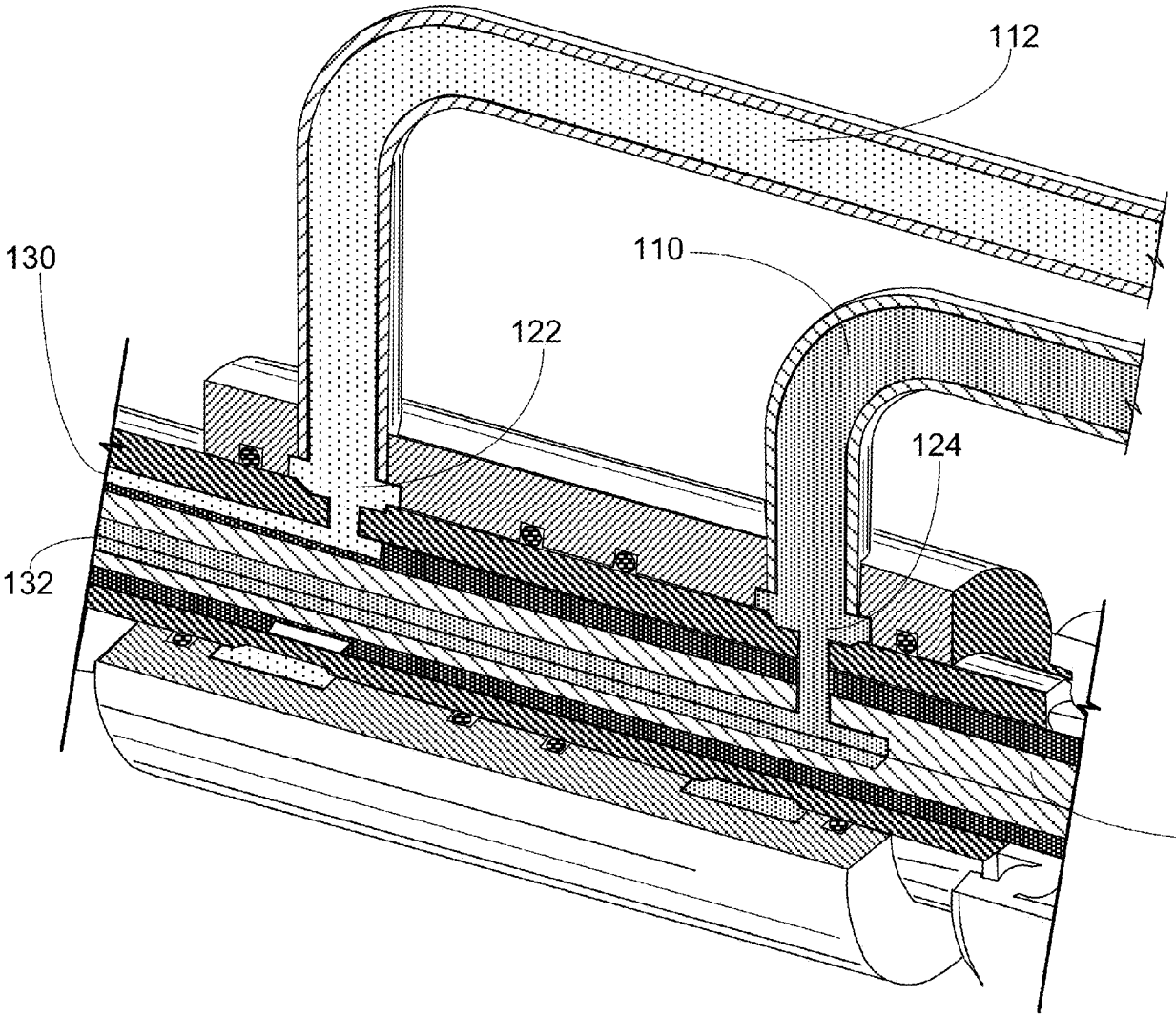
FIG. 8 is a close-up cross-sectional view of the inlet and outlet structures for a rotary heat exchanger the facilitate the input of a hot heat holding media and the output of a cooler heat holding media in accordance with one embodiment of the present invention of the rotary heat exchanger of FIG. 1.

If so desired, heat holding media transfer structure 114 includes insulation 142 between the cooled fluid channels and the heated, or hot, fluid channels to enhance the efficiency of rotary high density heat exchanger 100 (see FIG. 8). In another embodiment, heat holding media transfer structure 114 further comprises a plurality of O-rings 150 to provide structural support and rigidity to heat holding media transfer structure 114. As would be apparent to those of skill in the art, such O-rings and related structure are desirable due to the rotation movement that fins 104, heat holding media collector 106 and related fluid supply portions 108 and 103 undergo during the operation of rotary high density heat exchanger 100.

In one embodiment, fan blades, or fins, 104 can be fabricated from an efficient thermal transfer material with serpentine internal passages for refrigerant gas flow across the blades internal surfaces. Suitable materials to fabricate fan blades, or fins, 104 from include, but are not limited to aluminum, steel, stainless steel, copper, brass, titanium, silver, gold, etc. In another embodiment, fins 104 can be formed from any suitable thermally conductive metal or metal alloy, thermally conductive polymers, graphite, thermally conductive composite materials, or any suitable combination thereof.

In one embodiment, the benefits to having the exchange media as fan blades, or fins, 104 can be explained by the high turbulent airflows that can are generated via this layout. In a typical fan and heat exchanger system, it is difficult to obtain more than 400 feet per minute of air to blow across or through a heat exchanger element. This low flow rate is considered a laminar flow and does not yield high rate of thermal exchange. While not wishing to be bound to any one theory, it is believed that the design of rotary high density heat exchanger 100 enables one to achieve highly turbulent air flow across the exchanger elements at speeds of about 500 feet per minute, about 750 feet per minute, about 1,000 feet per minute, about 2,500 feet per minute, about 3,000 feet per minute, about 4,000 feet per minute about 5,000 feet per minute, about 7,500 feet per minute, about 10,000 feet per minute, about 12,500 feet per minute, about 15,000 feet per minute, about 17,500 feet per minute, or even about 20,000 feet per minute or greater since the blade, or fin, 104 itself contains a heat exchange structure and/or mechanism. Here, as well as elsewhere in the specification and claims, individual numerical values, or limits, from one or more embodiments and/or different ranges can be combined to form additional non-disclosed and/or non-stated ranges.

In light of the above, highly variable thermal loads can be compensated for by varying the rotational speed of rotary high density heat exchanger 100. The present invention's rotary high density heat exchanger's impedance point is very wide because the primary purpose of the device is to exchange heat with ambient air and air movement efficiencies are secondary benefits. The significance of this is further revealed in the quantum efficiency increases and the substantial reduction in system form factor.

Figure 5:
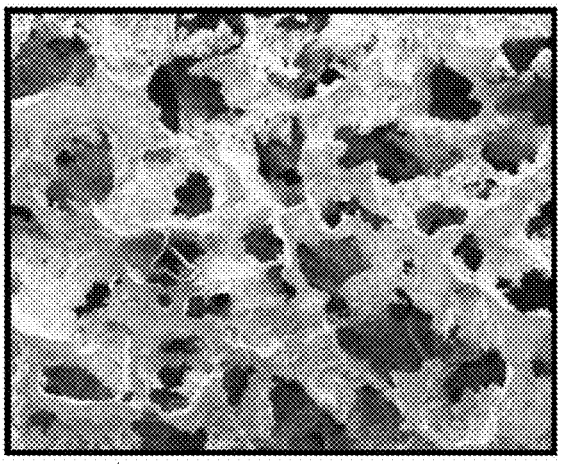
FIG. 5 is a close-up microscopic image of the foam metal matrix material of FIG. 4.
Figure 4:
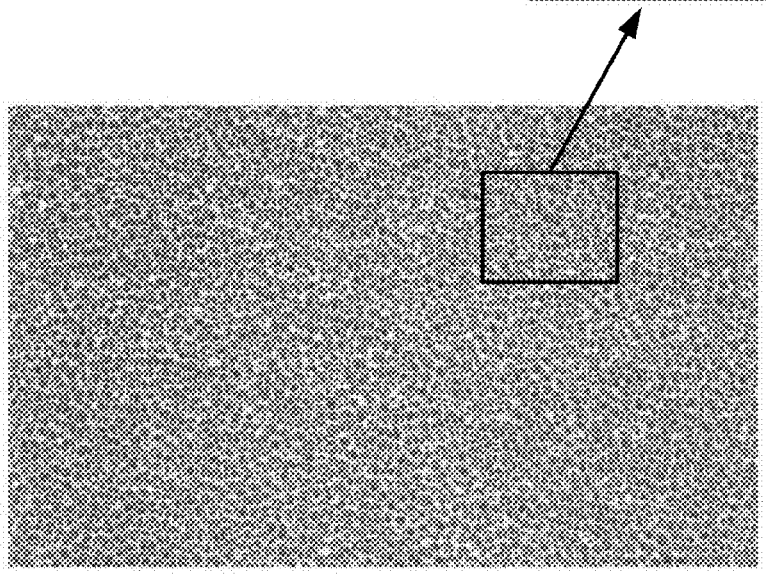
FIG. 4 is a microscopic image of a foam metal matrix material.
Figure 6:
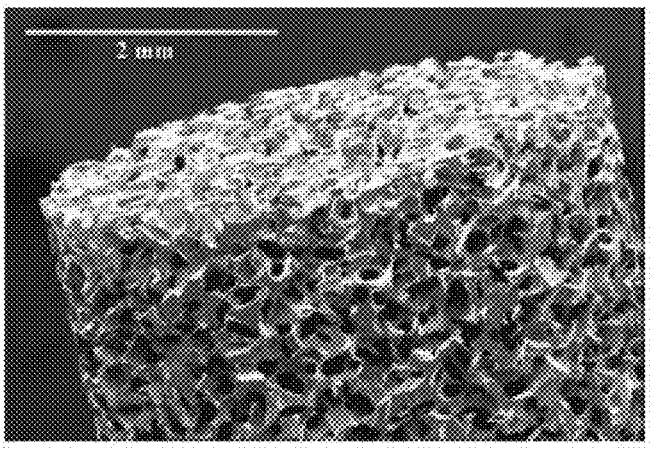
FIG. 6 is a microscopic image of another foam metal matrix material.
Figure 7:
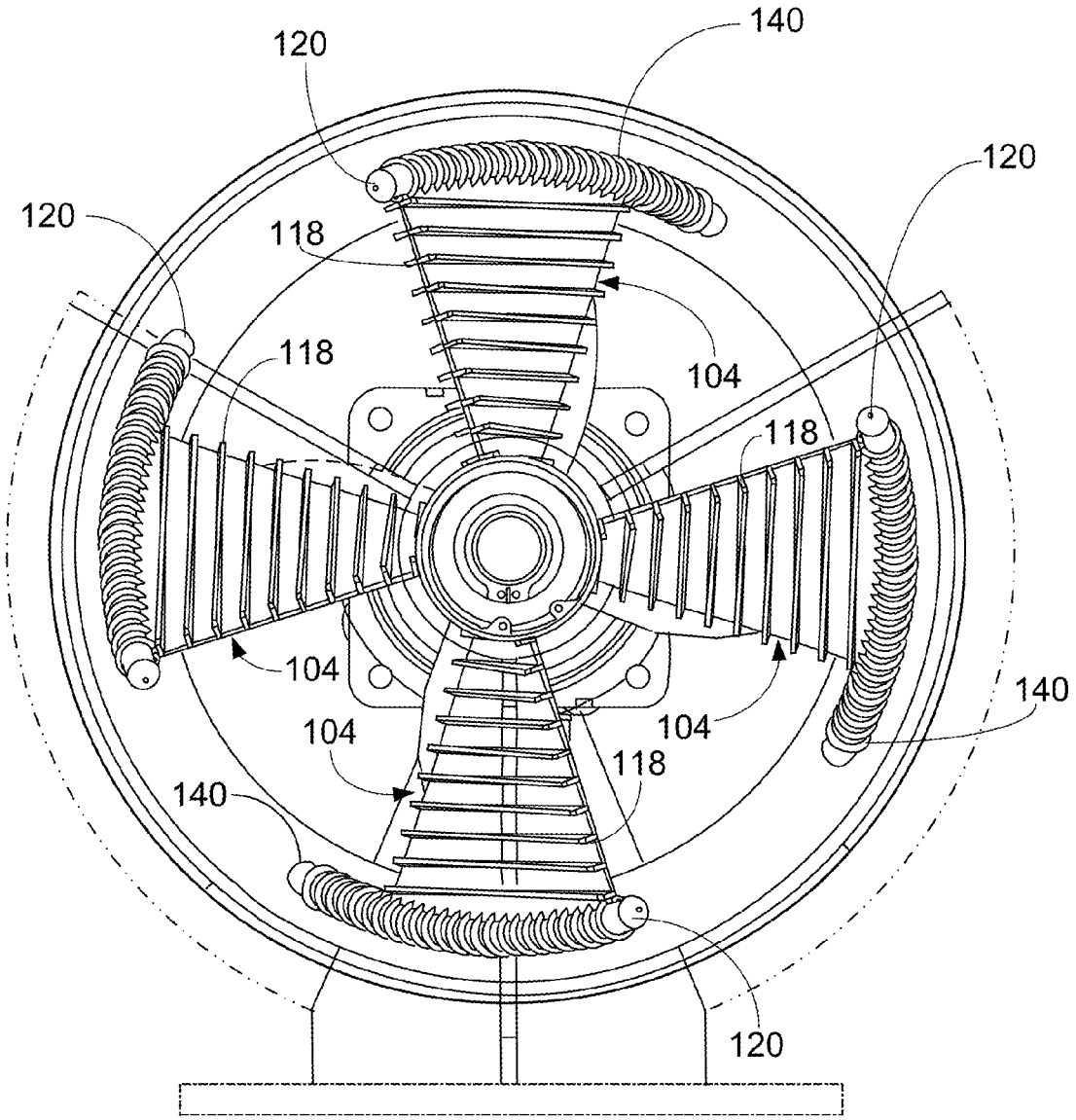
FIG. 7 is a partial end view of a rotary heat exchanger according to one embodiment of the present invention of the rotary heat exchanger of FIG. 1.

In one embodiment, rotary high density heat exchanger 100's blades, or fins 104 are airfoil shaped heat exchangers helically mounted on a central rotating shaft 108. FIG. 2 illustrates the internal heat media passageways 116 that allow gas, or fluid, flow within blades, or fins, 104. To increase thermal exchange rates, passageways 116 can be filled with a variety of porous thermal conductive materials such as foamed conductive metals, composites or hybrids, or a heat media passage of a given blade can be "filled" with one or more thermal conductive powders physically entrained within heat media passages 116. FIGS. 4 through 6 are microscopic images of various porous conductive materials that are suitable for use in conjunction with this embodiment of the present invention. Suitable thermal conductive materials include, but are not limited to, metal powders of various particle sizes, sintered conductive metals and metal alloys such as copper, aluminum and bronze, metal foam fabricated of copper, aluminum or other suitable metals or metal alloys, thermally conductive carbon fibers and composites thereof, etc.

In one embodiment, the operation of device 100 can be explained as follows: hot, or heated, refrigerant gas, or a transfer media, travels up center shaft 108. Attached to center shaft 108 are two or more, three or more, four or more, or even five or more, heat exchanging blades, or fins, 104 that have a serpentine, packed bed or other internal heat media passageways 116 therein that permit the refrigerant gas, or heat exchange fluid, to fluidically interact with various heat exchanging elements within the interior and exterior blades 104. In one embodiment, the gas, or heat transfer fluid, moves in a serpentine pattern horizontally through the interior heat media passageways 116 of the blades. In one embodiment, serpentine heat media passageways 116 are angled slightly upward to achieve and/or facilitate condensate, gas, or heat transfer fluid movement toward outer portion of blade, or fin, 104, and in some instances to prevent pooling of condensate, gas, or heat transfer fluid at, or near, center shaft 108. In some embodiments, heat sink fins 118 are formed on one or more external surfaces of the plurality of fins 104 so as to provide an increase in surface area for turbulent air to interact with the fin structures of the present invention so as to provide a more rapid and/or efficient thermal exchange with ambient air. By varying various design criteria such as blade pitch and speed of rotation, device 100 of the present invention can achieve a wide range of heat exchange rates.

Turning to fluid channel 120 of each respective fin 104, these channels 120 act as condensate collection tubes attached to the outside diameter of fins 104. As the condensate, gas, or heat transfer fluid cools within blades, or fins, 104, condensate may, or even does, form. Centrifugal force will cause any such condensate to the outside edges for collection. The collection tubes 120 are, in one embodiment, slightly angled to a larger diameter to support centrifugally generated movement of the condensate from the blade tip to cooled heat holding media collector 106. The collection tubes, or channels, 120 via a blade tip exit port enter cooled heat holding media collector 106 so as to enable transport of the cooled condensate, gas, or heat transfer fluid.

In one embodiment, cooled heat holding media collector 106 is a hollow disk structure designed to collect and transport liquid cooled condensate, gas, or heat transfer fluid toward center shaft 108. The internal structure of cooled heat holding media collector 106 is designed to pump liquid downward toward the center shaft by utilizing a scoop configuration oriented in a direction consistent with the direction of rotation. Liquid at the pickup position will be rotationally slower than the rotation of cooled heat holding media collector 106 thereby permitting the vane shaped channel to move liquid toward the center. Movement of the liquid refrigerant through the hollow receiver spokes is aided by gas flowing through the system. Once liquid enters and moves along center shaft 108, via a rotary union or other sealing device, it is then fluidically conveyed through pipes 130 to outlet 112 and then presented to an expansion valve for, for example, evaporator use. In one embodiment, outlet 112 may be fluidically connected to pump so as to assist in the transfer of cooled heat holding media to a device or situation where cooling is desired (e.g., an air conditioning unit, etc.). The receiver cutaway image as illustrated in FIG. 3 details the internal structure of this portion of device 100.

The design of device 100 of the present invention can be applied to a wide variety of applications ranging from micro-scale cooling to large industrial/commercial HVAC systems. Small scale utilization may be as simple as a single fan/exchanger blade set, while a large capacity system may require multiple banks of blade sets on a common shaft, similar in basic design to a multistage turbine. Even though the various embodiments described above are centered on refrigerant gases and its application, the technology can be applied to other gases, phase change materials, vapors, and liquids.

Materials such as aluminum and copper provide excellent thermal conductivity and offer a wide selection of alloys applicable to improve strength, manufacturing processing, corrosion protection and machinability. Carbon fiber composites and metal/composite matrix materials also offer high thermal conductivity with high strength.

One non-limiting advantage of the device of the present invention is that there are no air recirculation issues that reduce efficiencies or dead zones across heat exchange mediums. This is a true turbo-machine that combines fan and heat exchanger technology dramatically increasing heat exchanger efficiencies and capabilities per unit of surface area.

To facilitate highly efficient thermal transfer, the blade, or fin, design that is utilized in conjunction with device 100 of the present invention can be altered to provide a cavity to allow a "packed bed" pocket. Such an internal pocket can be filled with a conductive powder or micro or nano-structures such as; copper microspheres, copper or other conductive material plated carbon nano-fibers or graphenes, coated silicate nano-spheres, aluminum micro-spheres or nano particles, etc. In this embodiment, gas enters the lower portion of a blade, or fin, and migrates thru the packed bed to the outside or upper portion of the blade, or fin. The micro/nano materials can be sized to provide a slowing effect on the gas stream thereby permitting sufficient retention time for heat extraction from the gas, or heat transfer media. This packed bed technique can offer significant advantages over fine pitch flow passages or serpentine tube arrangements. Centrifugal force will maintain the structure of the bed during operation.

In another embodiment, sintered thermally conductive metals and metal matrixes can be substituted for the packed beds. Materials such as copper or aluminum can be readily sintered or formed into configurations that can provide sufficient porosity to allow gas to pass inter-spatially. Gas flow rates can be controlled by particle size and/or metal particle compaction levels. Open cell metal foams such as copper or aluminum foams can be produced with a variety of densities and interspatial passages. These foams can be manufactured in diverse shapes allowing specific configurations to be embedded within the blade structure. High surface area contact interfaces between particles provide excellent thermal energy transfer between gas, the metal matrix and the external heat sink device (fan blade). The metal matrix within the blades can be monolithic or segmented inserted into flow channels internal to the blade. Either configuration produces an advanced micro-channel heat exchange media without the high micro-machining costs typically associated with micro-channel production. The metal matrixes have a dual purpose. Primary purpose is to exchange thermal energy between a gas and the blade. Secondarily, the gas flow is slowed by virtue of the complex matrix of passageways allowed significant gas retention time for increased thermal exchange. FIGS. 4 through 6 are non-limiting example images of a copper foam metal configuration that can be inserted into fan blade interior and/or the passageways therein.

Given the above, the present invention is advantageous over other heat exchangers known in the art for at least the following non-limiting reasons. Advancement in forced-air heat exchanger technology is disadvantaged by the fundamental architectural limitations of the traditional exchanger design. It is well known that boundary layer effects impose fundamental limitations on cooling capabilities. A boundary layer can be thought of as a static insulative air layer that clings to the surface of heat sink or exchanger fins and acts like an insulating blanket. In conventional heat sink devices, the difference in temperature between the base of the finned heat sink and ambient air is almost entirely accounted for by the temperature drop across the boundary layer. Within the thermal boundary layer, molecular diffusion is the primary transport mechanism for conduction of heat, resulting in very poor heat transfer. Accordingly, the various embodiments of the present invention utilize boundary layer disruption. For example, air-jet-impingement cooling, in which a high-pressure pump generates a jet of compressed air that is directed at a heat sink surface, is very effective at reducing the thickness of the boundary layer. But the electrical power consumption and cost of air-jet-impingement cooling is prohibitive for the vast majority of applications. In devices such as the CPU cooler, although the fan generates a large amount of turbulence, only a modest reduction in the effective boundary layer thickness is observed relative to the case of laminar flow. This boundary-layer disruption effect can be increased to a small extent by running the fan at higher speed, but the tradeoff with respect to electrical power consumption quickly becomes very unfavorable. The device 100 of the present invention can reduce, mitigate and/or eliminate many of the above limitations by integrating blade and thermal conductor into the same form. The outer surfaces of the blades are helically contoured with a ribbed pattern resembling truncated heat sink fins. High velocity turbulent airflow provides maximum thermal transfer potential to ambient.

In another embodiment, at least about 25 percent or more, at least about 30 percent or more, at least about 40 percent or more, at least about 50 percent or more, at least about 60 percent or more, at least about 70 percent or more, at least about 75 percent or more, at least about 80 percent or more, or even at least about 90 percent or more of each of the surfaces of individual fins 104 is in close heat transfer contact with one or more internal heat media passages 116 of each individual fin 104. That is, each individual fin 104 has at least one internal heat media passage the lies under at least about 25 percent or more, at least about 30 percent or more, at least about 40 percent or more, at least about 50 percent or more, at least about 60 percent or more, at least about 70 percent or more, at least about 75 percent or more, at least about 80 percent or more, or even at least about 90 percent or more of each individual fin surface area. Here, as well as elsewhere in the specification and claims, individual numerical values, or limits, from one or more embodiments and/or different ranges can be combined to form additional non-disclosed and/or non-stated ranges.

In still another embodiment, at least about 25 percent or more, at least about 30 percent or more, at least about 40 percent or more, at least about 50 percent or more, at least about 60 percent or more, at least about 70 percent or more, at least about 75 percent or more, at least about 80 percent or more, or even at least about 90 percent or more of at least one of the surfaces of each individual fins 104 are covered with a plurality of heat sink fins 118. Here, as well as elsewhere in the specification and claims, individual numerical values, or limits, from one or more embodiments and/or different ranges can be combined to form additional non-disclosed and/or non-stated ranges.

In another embodiment, the present invention utilizes one or more heat media passageways 116 that have a geometrical layout shape and/or orientation that is not serpentine in nature. In this embodiment, any suitable geometric three dimensional passageway layout orientation can be utilized. Such layouts include, but are not limited to, diagonal interconnected passageways, cross-hatched interconnected passageways. Additionally, it should be noted that the heat transfer passageways 116 of the present invention are not limited to one cross-sectional geometry. Suitable cross-sectional geometries include, but are not limited to, circular, elliptical, rectangular, square, polygonal, etc. Given the above, the layout of the heat media passageways 116 of the present invention comprise both a cross-sectional geometry and a layout geometry selected from those detailed above.

While specific embodiments of the present invention have been shown and described in detail to illustrate the application and principles of the invention, it will be understood that it is not intended that the present invention be limited thereto and that the invention may be embodied otherwise without departing from such principles. In some embodiments of the invention, certain features of the invention may sometimes be used to advantage without a corresponding use of the other features. Accordingly, all such changes and embodiments properly fall within the scope of the following claims.

What is claimed is:

1. A rotary high density heat exchanger comprising:

a center shaft, wherein the center shaft is designed to permit the transfer of a heat transfer media;

at least two heat exchanger blades, wherein each of the at least two further comprises at least one heat transfer passageway within the internal structure of the blade that are fluidically connected to the center shaft so as to permit the flow of heat transfer media from the center shaft to an outer edge of a respective heat exchanger blade;

a heat transfer media collector, wherein the heat transfer media collector is fluidically connected to at least one outer portion of a respective heat transfer passageway in order to collect cooled heat transfer media; and a double hollow shaft, wherein one portion of the double hollow shaft is designed to be fluidically connected to the center shaft in order to supply hot, or heated, heat transfer media to the center shaft and wherein the other portion of the double hollow shaft is designed to be fluidically connected to the heat transfer media collector in order to supply cooled heat transfer media for a cooling application, wherein the heat transfer passageway in each of the at least two heat exchanger blades is serpentine in shape, and wherein the heat transfer media collector is formed so as to have an outer wheel-shaped portion that is fluidically connected to a plurality of fluid conveying spokes so as to convey heat transfer media to a portion of the double hollow shaft.

2. The rotary high density heat exchanger of claim 1, wherein the heat exchanger has at least three heat exchanger blades.

3. The rotary high density heat exchanger of claim 1, wherein the heat exchanger has at least four heat exchanger blades.

4. The rotary high density heat exchanger of claim 1, wherein the heat exchanger has at least five heat exchanger blades.

5. The rotary high density heat exchanger of claim 1, wherein the heat exchanger achieves highly turbulent air flow across the exchanger elements at speeds of about 500 feet per minute.

6. The rotary high density heat exchanger of claim 1, wherein the heat exchanger achieves highly turbulent air flow across the exchanger elements at speeds of about 5,000 feet per minute.

7. The rotary high density heat exchanger of claim 1, wherein the heat exchanger achieves highly turbulent air flow across the exchanger elements at speeds of about 10,000 feet per minute.

8. The rotary high density heat exchanger of claim 1, wherein the heat exchanger achieves highly turbulent air flow across the exchanger elements at speeds of about 15,000 feet per minute.

9. The rotary high density heat exchanger of claim 1, wherein the heat exchanger achieves highly turbulent air flow across the exchanger elements at speeds of about 20,000 feet per minute or greater.

10. The rotary high density heat exchanger of claim 1, wherein the passageway in each of the at least two heat exchanger blades further comprises at least one conductive material, powder or particles within at least a portion of the passageway.

11. The rotary high density heat exchanger of claim 1, wherein at least 25 percent or more of the surface area of each individual heat exchanger blade has at least one heat transfer passageway thereunder.

12. The rotary high density heat exchanger of claim 11, wherein at least 50 percent or more of the surface area of each individual heat exchanger blade has at least one heat transfer passageway thereunder.

13. The rotary high density heat exchanger of claim 11, wherein at least 60 percent or more of the surface area of each individual heat exchanger blade has at least one heat transfer passageway thereunder.

14. The rotary high density heat exchanger of claim 11, wherein at least 75 percent or more of the surface area of each individual heat exchanger blade has at least one heat transfer passageway thereunder.

15. The rotary high density heat exchanger of claim 11, wherein at least 90 percent or more of the surface area of each individual heat exchanger blade has at least one heat transfer passageway thereunder.

16. The rotary high density heat exchanger of claim 1, wherein at least 25 percent or more of at least one of the surfaces of an individual heat exchanger blade is covered with heat sink fins.

17. The rotary high density heat exchanger of claim 16, wherein at least 50 percent or more of at least one of the surfaces of an individual heat exchanger blade is covered with heat sink fins.

18. The rotary high density heat exchanger of claim 16, wherein at least 60 percent or more of at least one of the surfaces of an individual heat exchanger blade is covered with heat sink fins.

19. The rotary high density heat exchanger of claim 16, wherein at least 75 percent or more of at least one of the surfaces of an individual heat exchanger blade is covered with heat sink fins.

20. The rotary high density heat exchanger of claim 16, wherein at least 90 percent or more of at least one of the surfaces of an individual heat exchanger blade is covered with heat sink fins.

21. A rotary high density heat exchanger comprising:

a center shaft, wherein the center shaft is designed to permit the transfer of a heat transfer media;

at least two heat exchanger blades, wherein each of the at least two further comprises at least one heat transfer passageway within the internal structure of the blade that are fluidically connected to the center shaft so as to permit the flow of heat transfer media from the center shaft to an outer edge of a respective heat exchanger blade;

a heat transfer media collector, wherein the heat transfer media collector is fluidically connected to at least one outer portion of a respective heat transfer passageway in order to collect cooled heat transfer media; and a double hollow shaft, wherein one portion of the double hollow shaft is designed to be fluidically connected to the center shaft in order to supply hot, or heated, heat transfer media to the center shaft and wherein the other portion of the double hollow shaft is designed to be fluidically connected to the heat transfer media collector in order to supply cooled heat transfer media for a cooling application, wherein the heat transfer passageway in each of the at least two heat exchanger blades is serpentine in shape, and wherein each heat exchanger blade contains a plurality of heat exchange fins one at least one external surface thereof, wherein the heat transfer media collector has an outer diameter defining an outer edge of the heat exchanger blades located distal from the double hollow shaft, and wherein the heat transfer media collector is formed so as to have an outer wheel-shaped portion that is fluidically connected to a plurality of fluid conveying spokes so as to convey heat transfer media to a portion of the double hollow shaft.

22. The rotary high density heat exchanger of claim 21, wherein the heat exchanger has at least three heat exchanger blades.

23. The rotary high density heat exchanger of claim 21, wherein the heat exchanger has at least four heat exchanger blades.

24. The rotary high density heat exchanger of claim 21, wherein the heat exchanger has at least five heat exchanger blades.

25. The rotary high density heat exchanger of claim 21, wherein the heat exchanger achieves highly turbulent air flow across the exchanger elements at speeds of about 500 feet per minute.

26. The rotary high density heat exchanger of claim 21, wherein the heat exchanger achieves highly turbulent air flow across the exchanger elements at speeds of about 5,000 feet per minute.

27. The rotary high density heat exchanger of claim 21, wherein the heat exchanger achieves highly turbulent air flow across the exchanger elements at speeds of about 10,000 feet per minute.

28. The rotary high density heat exchanger of claim 21, wherein the heat exchanger achieves highly turbulent air flow across the exchanger elements at speeds of about 15,000 feet per minute.

29. The rotary high density heat exchanger of claim 21, wherein the heat exchanger achieves highly turbulent air flow across the exchanger elements at speeds of about 20,000 feet per minute or greater.

30. The rotary high density heat exchanger of claim 21, wherein the passageway in each of the at least two heat exchanger blades further comprises at least one conductive material, powder or particles within at least a portion of the passageway.

31. The rotary high density heat exchanger of claim 21, wherein at least 25 percent or more of the surface area of each individual heat exchanger blade has at least one heat transfer passageway thereunder.

32. The rotary high density heat exchanger of claim 31, wherein at least 50 percent or more of the surface area of each individual heat exchanger blade has at least one heat transfer passageway thereunder.

33. The rotary high density heat exchanger of claim 31, wherein at least 60 percent or more of the surface area of each individual heat exchanger blade has at least one heat transfer passageway thereunder.

34. The rotary high density heat exchanger of claim 31, wherein at least 75 percent or more of the surface area of each individual heat exchanger blade has at least one heat transfer passageway thereunder.

35. The rotary high density heat exchanger of claim 31, wherein at least 90 percent or more of the surface area of each individual heat exchanger blade has at least one heat transfer passageway thereunder.

36. The rotary high density heat exchanger of claim 21, wherein at least 25 percent or more of at least one of the surfaces of an individual heat exchanger blade is covered with heat sink fins.

37. The rotary high density heat exchanger of claim 36, wherein at least 50 percent or more of at least one of the surfaces of an individual heat exchanger blade is covered with heat sink fins.

38. The rotary high density heat exchanger of claim 36, wherein at least 60 percent or more of at least one of the surfaces of an individual heat exchanger blade is covered with heat sink fins.

39. The rotary high density heat exchanger of claim 36, wherein at least 75 percent or more of at least one of the surfaces of an individual heat exchanger blade is covered with heat sink fins.

40. The rotary high density heat exchanger of claim 36, wherein at least 90 percent or more of at least one of the surfaces of an individual heat exchanger blade is covered with heat sink fins.

* * * * *